US006224824B1

(12) United States Patent
Zhang et al.

(10) Patent No.: US 6,224,824 B1
(45) Date of Patent: May 1, 2001

(54) METHOD OF USING ALLOY STEEL HAVING SUPERIOR CORROSION RESISTANCE IN CORROSIVE ENVIRONMENT CONTAINING MOLTEN SALTS CONTAINING ALKALI OXIDES

(75) Inventors: Jun Shan Zhang, Dalian (CN); Young Joon Shin, Taejon-si (KR); Soo Haeng Cho, Taejon-si (KR); Hyun Soo Park, Taejon-si (KR)

(73) Assignee: Korea Electric Power Corporation (KR)

( * ) Notice: Subject to any disclaimer, the term of this patent is extended or adjusted under 35 U.S.C. 154(b) by 0 days.

(21) Appl. No.: 09/465,575

(22) Filed: Dec. 17, 1999

(30) Foreign Application Priority Data

Nov. 22, 1999 (KR) ..... 99-51890

(51) Int. Cl.[7] ..... C22C 38/08; C22C 38/40; C21D 8/00

(52) U.S. Cl. ..... 420/94; 420/97; 148/653; 148/335; 148/336

(58) Field of Search ..... 420/94, 97; 148/336, 148/653, 335

(56) References Cited

U.S. PATENT DOCUMENTS 4,610,437 * 9/1986 Baudis et al. ..... 420/97

FOREIGN PATENT DOCUMENTS

1074245 * 7/1967 (GB) ..... 420/97
2041405A * 9/1980 (GB) ..... 420/94
405279785A * 10/1993 (JP) .

* cited by examiner

*Primary Examiner*—Deborah Yee
(74) *Attorney, Agent, or Firm*—Bachman & LaPointe, P.C.

(57) ABSTRACT

Disclosed is an alloy steel of high corrosion resistance to hot molten salts containing chlorides and/or alkali oxides. The alloy steel is manufactured from a composition comprising 20–40 weight % of Ni, 0–8 weight % of Cr, 0.05 weight % or less of C, 0.5 weight % or less of Si, 1.0 weight % or less of Mn, 0.05 weight % or less of S, and the balance of Fe to total weight. With a low Cr content, the alloy steel is superb in the corrosion resistance to chloride and/or alkali oxide-containing molten salts, including LiCl—$Li_2O$. Also, the alloy steel shows stable corrosion resistance to molten salts even at high temperature as well as low temperature in addition to being superior to workability. Thus, the alloy steel can be processed into plates, bars or pipes which are used for structural materials and structural components for treating molten salts.

8 Claims, 4 Drawing Sheets

METHOD OF USING ALLOY STEEL HAVING SUPERIOR CORROSION RESISTANCE IN CORROSIVE ENVIRONMENT CONTAINING MOLTEN SALTS CONTAINING ALKALI OXIDES

BACKGROUND OF THE INVENTION

1. Field of the Invention

The present invention relates to a Ni—Cr—Fe based alloy steel of high corrosion resistance against hot molten salts containing chlorides and/or alkali oxides. Particularly, the present invention relates to a Ni—Cr—Fe based alloy steel which has a low Cr content so that its corrosion resistance to hot molten salts can be greatly improved. Also, the present invention is concerned with the use of the alloy steel in the structural materials and the structural components for treating hot molten salts.

2. Description of the Prior Art

With characteristic physicochemical properties, such as high electrical conductivity, high concentrated and convenient treatment and flowability, molten salts have been utilized in various industrial techniques, especially in jet engines, fuel cells, and catalysts. In addition, molten salts are applied for solar energy utilization and metal refining. Accordingly, active research has also continued to be directed to methods and vessels for treating molten salts, particularly at high temperatures and to corrosion-resistant materials for the vessels.

For instance, sulfate-based molten salts, exemplified by $Na_2SO_4$, $Na_2SO_4$—NaCl, $Na_2SO_4$—$V_2O_5$ and $Na_2SO_4$—$Li_3SO_4$ are usually used in jet engines and gas turbines. As materials for this type of equipment and for use in electrochemical test for corrosion resistance to such sulfate-based molten salts, there are known Inconel 600, Inconel 825, Nimocast 713, SUS 304, SUS 310, MA 956, SS41 and Incoloy 800 (Wu, C. X., Corrosion control-7th APCCC, Vol. 1, pp 136–141, 1991; Santorelli, R., Mater. Sci. Eng. A120–A121, (1-2), 283–291, 1989).

Carbonate-based molten salts, exemplified by $Li_2CO_3$, $Na_2CO_3$—NaCl, $Na_2CO_3$—$Na_2SO_4$ and $Na_2CO_3$—$K_2CO_3$, can be found in fuel cells, reactors and boilers. These vessels are usually made of Inconel 600, X2 (16.5–18.5% Cr, 11–14% Ni, 2–2.5% Mo), X12 (24–26% Cr, 19–22% Ni) or an alloy steel comprising 30% Cr-45% Ni-1% Al-0.03% Y (Park, H-H., J. Society Material Engineering for Resources of Japan, 10(2), 18–26, 1997; Sasaki, M., Corrosion Engineering, 45(4), 192–200, 1996).

As for nitrate-based molten salts, exemplified by $NaNO_3$, $Ba(NO_3)_2$, $NaNO_3$—$KNO_3$, etc., they are used for heat recovery. SUS 304, SS 41, Inconel 600 (Inco Alloys International, U.S.A.), Inconel 625, Hastelloy-N, and Hastelloy-X are electrochemically tested for corrosion resistance to such molten salts and used for the structural component treating the said molten salts (Ebara, R., J. Jpn. Inst. Met., 52(5), 508–516, 1988; Nishikata, A., J. Jpn. Inst. Met., 45(6), 610–613, 1981).

It is also known that SUS 304 and Hastelloy-N are resistant to the corrosion caused by halide-based molten salts, exemplified by LiCl—KCl, LiF—KF, LiF—NaF—KF, KCl—$BaCl_2$—NaF, KCl—NaCl—NaF, etc. (Iwamoto, N., Trans. JWRI., 9(2), 117–119, 1980).

Other references directed to alloy steels with corrosion resistance to molten salts are found in many patents.

Japanese Pat. Laid-Open Publication No. Heisei 8-41595 discloses an Fe—Ni—Cr based alloy steel used where there is needed high corrosion resistance to chloride-based molten salts, specifying a composition which comprises 0.05–1.5% of Mn, 18–30% of Cr and 10–35% of Ni under the condition of Cr/Fe=0.33–0.7 and Ni/Fe=0.33–1.0. Japanese Pat. Laid-Open Publication No. Heisei 5-279811 suggests an alloy steel composed mainly of 2% or less of Si, 1% or less of Mn, 25–40% of Co, 12–18% of Cr, 10–40% of Ni, 2–4% of Mo, and 8% of W as a material for boilers superior in corrosion resistance to molten salts.

U.S. Pat. No. 5,223,214 describes an alloy steel used where resistance to heat and corrosion is needed as in, for example, boilers and waste incinerators, which is composed mainly of 10.5–28% of Ni, 14.8–23% of Cr, 3–6.6% of Si, 0–4% of Al, 0.15–1.6% of Mo, and 0.25–1.25% of W. Canadian Pat. No. 2,084,912 introduces a corrosion-resistant alloy steel for boilers, which comprises 10–25% of Co, 18–28% of Cr, 10–50% of Ni, 2–4% of Mo, and 8% or less of W.

Japanese Pat. Laid-Open Publication No. Heisei 7-268565 is directed to an alloy steel which is composed mainly of 2–4% of Si, 22–25% of Ni, 24–30% of Cr, and 1–2% of Mo. It is described that the alloy steel is superior in hot workability and shows high corrosion resistance even in a hot condition comprising hydrochloride gas, molten salts, sulfuric acid, and/or alkali, so that it is useful as a material for steam boilers which are usually operated at high temperature and high pressure. Japanese Pat. Laid-Open Publication No. Heisei 5-117816 discloses an alloy steel useful for heat exchangers and heat engines, which are usually exposed to hot, corrosive environments comprising sulfates and chloride-based molten salts. The alloy steel comprises mainly 12–30% of Ni, 18–30% of Cr and 2% or more of Mo.

In Japanese Pat. Laid-Open Publication No. Sho. 57-39159 is disclosed an $Al_2O_3$-coated austenite alloy steel resistant to oxidation and heat, comprising 10–40% of Ni, 11–32% of Cr, 4.5–9% of Al, 3% or less of Si and 2% or less of Mn. Composed of 5% or less of Si, 1.5% or less of Mn, 8–70% of Ni, and 15–35% of Cr, an alloy steel resistant to molten borax-caused corrosion-resistant alloy steel is disclosed in Japanese Pat. Laid-Open Publication No. Sho. 56-150162. An alloy steel disclosed in Japanese Pat. Laid-Open Publication No. Sho. 190143 is used in molten carbonate type fuel cells, comprising 1% or less of Si, 2% or less of Mn, 15–35% of Ni and 15–35% of Cr.

Japanese Pat. Laid-Open Publication No. Heisei 6-145857 discloses an alloy steel for boilers, which is highly resistant to molten salt-caused corrosion in addition to being good in on-site workability. The alloy steel is prepared from a composition comprising 2.5% or less of Si, 1% or less of Mn, 40–55% of Co, 7–12% of Cr, 10–30% of Ni, 2–4% of Mo, and 8% or less of W. Another alloy steel suitable for boilers is found in Japanese Pat. Laid-Open Publication No. Heisei 5-279785. Showing high corrosion resistance to molten salts, especially molten chlorides, the alloy steel is composed mainly of 2.5% or less of Si, 1% or less of Mn, 40–55% of Co, 7–12% of Cr, 10–30% of Ni, 2–4% of Mo, and 8% or less of W. These last two above-cited references teach that an improvement in corrosion resistance of the alloy steels can be obtained when adding Co, Ni, Cr and Mo in cooperation, but not when alone.

The above-illustrated alloy steels are characterized in that they have high contents of Cr or comprise W, V and/or Mo. Such conventional alloy steels, however, are reported in many articles to be unsuitable as materials for treating single or complex molten salts, including alkali oxides (J. A.

Goebel, F. S. Pettit and G. W. Goward, Met. Trans. 4, 261 (1973)). Particularly, chloride-based molten salts are so highly hydrophilic that they are easily hydrated when being exposed to the air. Thus, changes occur in the composition of the molten salts, having great influence on the corrosion resistance of the alloy steels. Coexistence of molten salts and oxides makes their physical and chemical properties more complex, resulting in accelerating corrosion. Thus far, sufficient research has not been done in regard to the complex corrosive situation. Further, the conventional alloy steels cannot sustain themselves for a long period of time in such molten salt's corroding conditions. Particularly, no alloy steels have been developed which are of high corrosion resistance to molten salts containing alkali oxides such as LiCl—$Li_2O$.

Before the present invention is disclosed or described, it must be noted that, as used in the specification and the appended claims, the term "%" means weight % unless the context clearly dictates otherwise.

SUMMARY OF THE INVENTION

The intensive and thorough research on alloy steels superior in corrosion resistance to molten salts containing chlorides and/or alkali oxides, repeated by the present inventor, resulted in the finding that the corrosion resistance of Ni—Cr—Fe based alloys to such molten salts can be improved by lowering the Cr content to a suitable range.

Therefore, it is an object of the present invention to overcome the above problems encountered in prior arts and to provide an alloy composition of high corrosion resistance to chloride and/or alkali oxide-containing hot molten salts.

It is another object of the present invention to provide a method of manufacturing an alloy steel of high corrosion resistance to hot molten salts.

It is a further object of the present invention to provide an alloy steel superior in corrosion resistance to hot molten salts containing chlorides and/or alkali oxides.

It is still a further object of the present invention to provide the use of the alloy steel in the structural materials and the structural components for treating molten salts.

In an embodiment of the present invention, there is provided an alloy composition of high corrosion resistance to hot molten salts, comprising 20–40 weight % of Ni, 0–8 weight % of Cr, 0.05 weight % or less of C, 0.5 weight % or less of Si, 1.0 weight % or less of Mn, 0.05 weight % or less of S, and the balance of Fe to total weight. In an aspect of the embodiment, the molten salts contain chlorides and/or alkali oxides. The alloy composition is highly resistant to the corrosion caused by $Li_2O$, LiCl, $Na_2O$ or LiCl—$Li_2O$ even at high temperatures of up to 900° C.

In another embodiment of the present invention, there is provided a method of manufacturing alloy steels of high corrosion resistance to hot molten salts, comprising the step of casting the alloy composition. In an aspect, the method further comprises the step of hot-rolling. In another aspect, the method further comprises the step of conducting a heat treatment after the hot-rolling step. The hot-rolling step is conducted at 1,000–1,200° C. after the cast is heated at 1,200° C. for 1–2 hours in an inert gas atmosphere. The heat treatment is also preferably conducted at 1,000–1,100° C. for 1–2 hours in an inert gas atmosphere.

In a further embodiment of the present invention, there is provided an alloy steel of high corrosion resistance to hot molten salts, manufactured from the alloy composition.

In still a further embodiment of the present invention, there is provided a structural material or a structural component for treating hot molten salts, manufactured from the alloy steel. In an aspect, the structural material is in the form of a plate, a bar, or a pipe, or the composite form thereof. In another aspect, the structural material is a valve, a fitting, or a flange.

BRIEF DESCRIPTION OF THE DRAWINGS

The above and other objects, features and other advantages of the present invention will be more clearly understood from the following detailed description taken in conjunction with the accompanying drawings, in which.

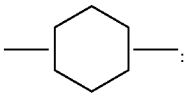

Figure 2:
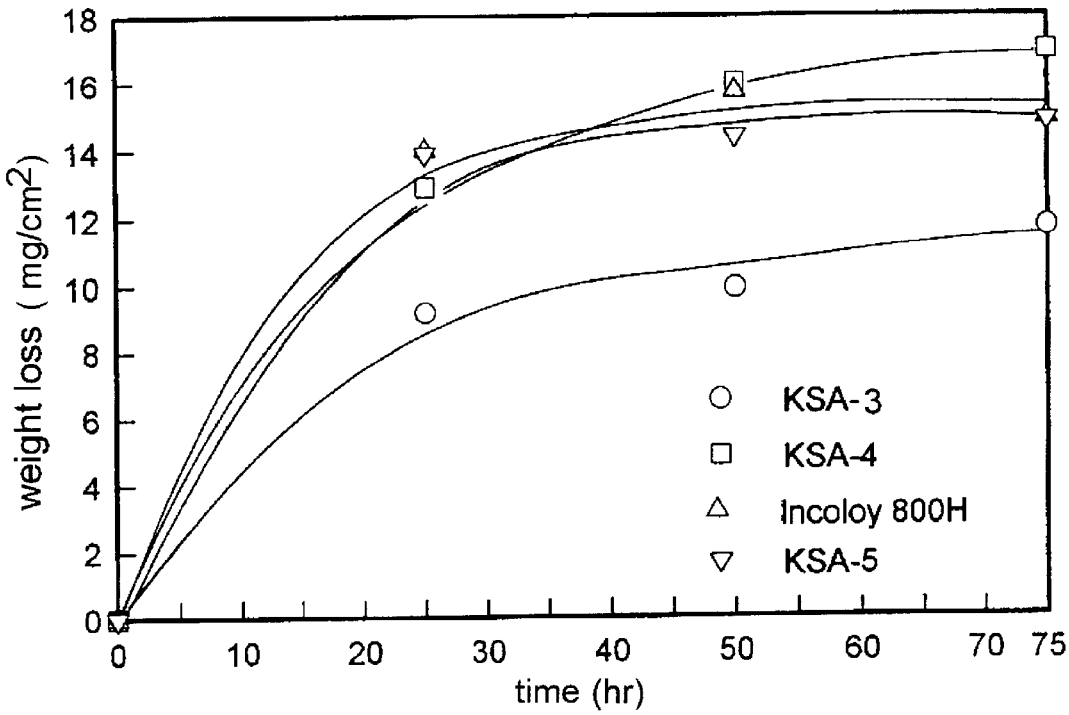
Figure 3:
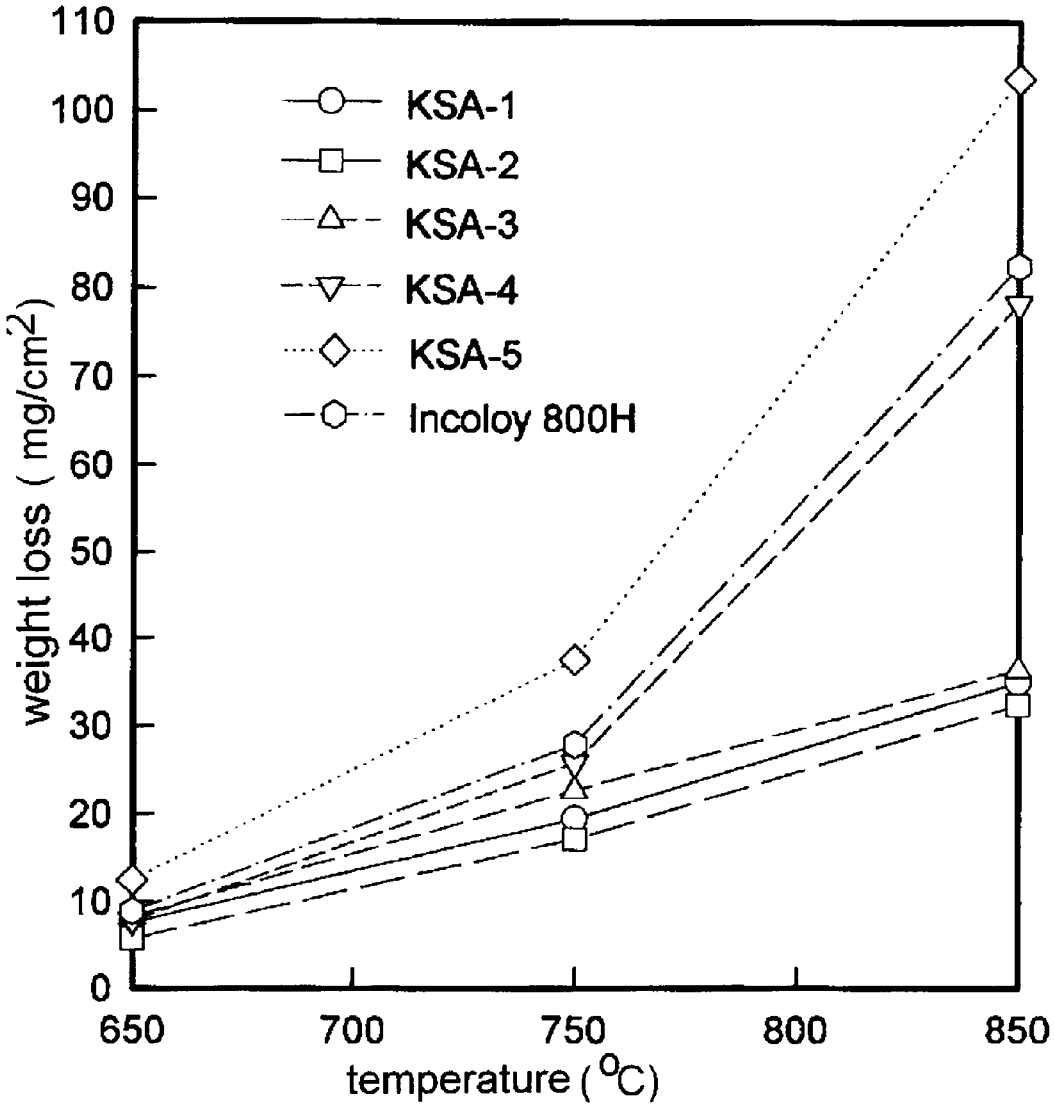

Incoloy 800H;

FIG. 2 is a graph in which weight loss is plotted for various alloy steels with regard to corrosion period after the alloy steels are allowed to be corroded by LiCl at 750° C.: -○-: KSA-3; -Δ-: Incoloy 800H; -□-: KSA-4; -▽-: KSA-5;

FIG. 3 is a graph in which weight loss is plotted for various alloy steels with regard to temperature after the alloy steels are allowed to be corroded by LiCl—$Li_2O$ for 25 hours: -○-: KSA-1; -□-: KSA-2; -Δ-: KSA-3; -▽-: KSA-4; -◇-: KSA-5;

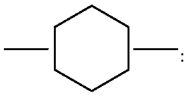

Incoloy 800H; and

Figure 4:
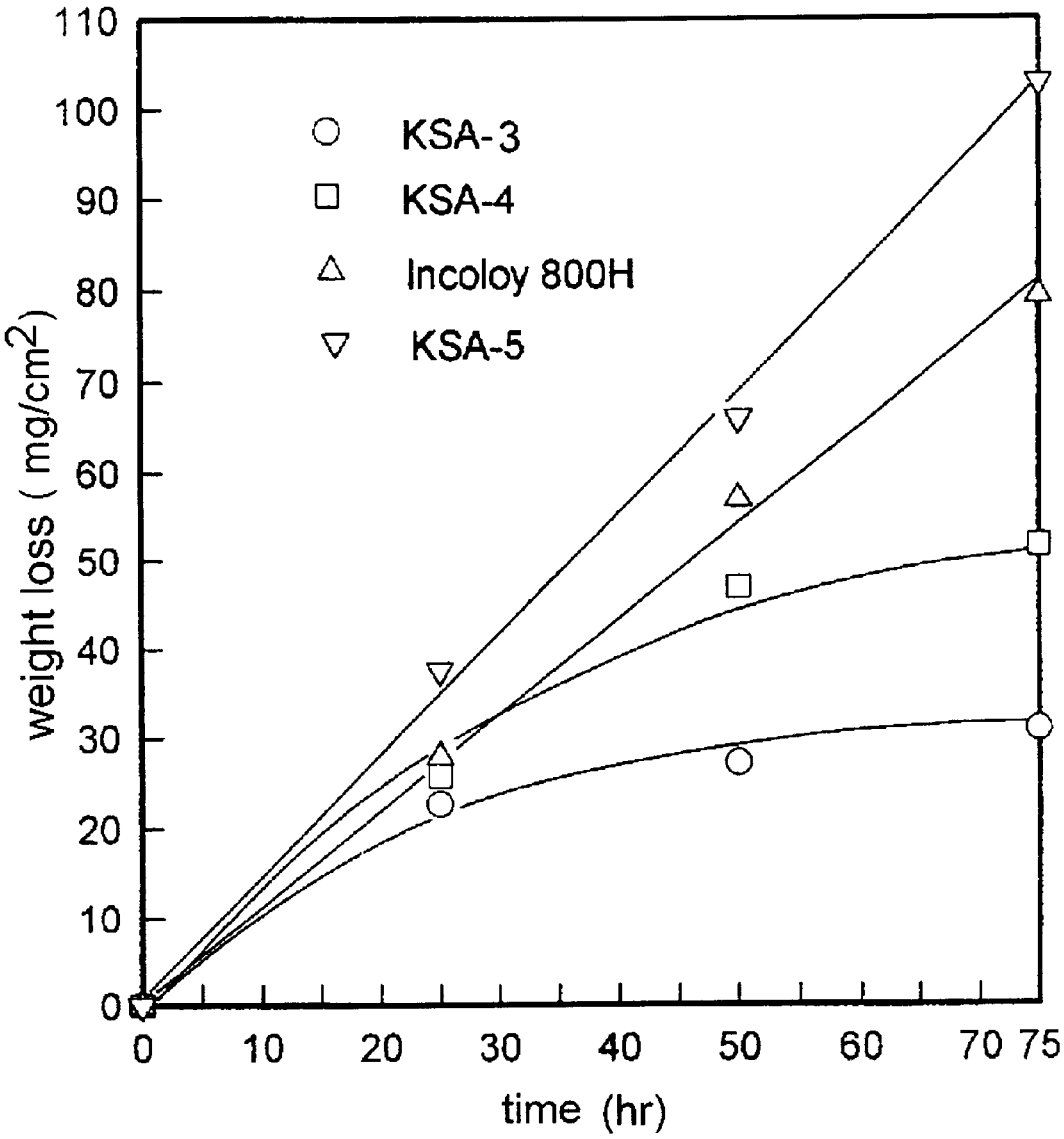

FIG. 4 is a graph in which weight loss is plotted for various alloy steels with regard to corrosion period after the alloy steels are allowed to be corroded by LiCl—$Li_2O$ at 750° C.: -○-: KSA-3; -□-: KSA-4; -▽-: KSA-5; -Δ-: Incoloy 800H.

DETAILED DESCRIPTION OF THE INVENTION

The present invention is directed to materials which are suitable for molten salt-treating equipment by virtue of their superior corrosion resistance to molten salts containing chlorides and/or alkali oxides. In developing such materials, it is helpful to know how hot molten salts corrode steels. In this regard, an examination is made of the corrosion resistance of various alloy steels: ordinary stainless steel; heat resistant alloy; SUS 304L (POSCO, Korea; Cr 17.84%, Ni 9.85%, C 0.023%, Si 0.50%, Mn 1.07%, P 0.022%, S 0.004%, Mo 0.11%, Fe the balance); More 1 (Stainless Steel Handbook, Japan; Ni 33%, Cr 25%, C 0.42%, Si 0.7%, Mn 1.0%, W 1.5%, Fe the balance); Super 22H (Taihei Kinjoku Kogyo, Japan; Ni 45–50%, Cr 32–34%, W 5%, Co 3%, C 0.3–0.5%, Si<2.0%, Mn <2.0%, Fe the balance); Incoloy 800H (High Performance Alloys, U.S.A.; Ni 31.34%, Cr 21.82%, Al 0.32%, C 0.079%, Cu 0.60%, Mn 1.07%, S 0.006%, Si 0.55%, Tl 0.32%, Fe the balance); Inconel 600 (Inco Alloys International, U.S.A.; C 0.07%, Mn 0.20%, Fe 9.49%, S 0.002%, Si 0.21%, Cu 0.07%, Ni 73.66%, Cr 16.30%); and Hastelloy C-276 (Inco Alloys International, U.S.A.; Ni 59.24%, Cr 15.58%, Mo 15.48%, Fe 5.25%, W 3.84%, C 0.006%, Mn 0.40%, S<0.001%, Si 0.052%, Co 0.13%, F 0.006%, V 0.01%).

When these alloys are subjected to treatment with LiCl molten salts, corrosion is slowly proceeded because dense, protective oxide coatings, consisting mainly of $LiCrO_2$, are formed on them. In kinetics, the corrosion rate of LiCl molten salts on these alloys is changed with the lapse of time, following a parabolic pattern. Under the condition of LiCl—$Li_2O$ molten salts, on the other hand, porous, non-protective scales, composed mainly of $LiCrO_2$, grow inward at the scale/alloy interface, showing a linear kinetic characteristic in the corrosion rate on the test alloys. In total, the alloys are corroded at even faster rates in LiCl—$Li_2O$ molten salt conditions than in LiCl molten salt conditions.

Acceleration in the corrosion rate can be explained by the basic fluxing mechanism attributed to $Li_2O$. $Cr_2O_3$ itself, the scales formed on the alloys, serves as a protective oxide. However, when reacting with the oxide ion $O^{2-}$ ($Li_2O$), the $Cr_2O_3$ is converted to chromate $CrO_4^{2-}$, which is dissolved by molten salts. Accordingly, the protective scale disappears from the surface of the alloys, so that the bare metal comes into direct contact with the molten salts. Consequently, the corrosion rate increases with the lapse of time.

In principle, the acceleration of corrosion rate caused by the mixed molten salt LiCl—$Li_2O$ is identical to the accelerated oxidation of Ni-based alloys caused by film phase molten salt $Na_2SO_4$. However, the mixed molten salt LiCl—$Li_2O$ is different from the film phase molten salt $Na_2SO_4$ in the following two phenomena: 1) In the case of the mixed molten salt LiCl—$Li_2O$, $Cr_2O_3$ is dissolved while $LiCrO_2$ is deposited; 2) Whereas the accelerated oxidation caused by the film phase molten salt $Na_2SO_4$ can be restrained by increasing the Cr concentration of the Ni-based alloys because of the low activity of $O^{2-}$, the increasing of the Cr concentration promotes the corrosion activity of the mixed molten salt LiCl—$Li_2O$ on the alloys, as apparent from the fact that More 1 or Super 22H is corroded at a faster rate than Incoloy 800H or stainless steel.

Thus, it is expected that alloys with high contents of Cr are vulnerable to the corrosion of molten salts. Because of high contents of Cr, most of the conventional heat-resistant alloys are not suitable as materials for structural components for treating molten salts.

In the present invention, new Fe—Ni—Cr based alloy compositions are prepared by modifying the Cr content on the basis of the composition of Incoloy 800H and an examination is made of the corrosion properties of the alloys prepared from the new compositions. As will be in detail described, the data obtained in the examination shows that Ni—Cr—Fe based alloys with lower Cr content are more resistant to the corrosion of molten salts containing chlorides and/or alkali oxides. Particularly, a Cr content of 8 wt % or less makes the alloys have high corrosion resistance to the molten salts.

In accordance with an embodiment of the present invention, there is provided an alloy steel composition resistant to the corrosion of hot molten salts containing chlorides and/or alkali oxides, which comprises 20–40 wt % of Ni, 0–8 wt % of Cr, 0.05 wt % or less of C, 0.5 wt % or less of Si, 1.0 wt % or less of Mn, 0.05 wt % or less of S, and the balance amount of Fe to total weight.

For example, if C is present at an amount of more than 0.05 wt %, the alloy shows poor corrosion resistance to molten salts. Serving as a deoxidizing ingredient, Si has a negative influence on the hot processability of the alloy if its amount exceeds 0.5 wt %. In the alloy, S is an impurity, but an inevitable ingredient. Accordingly, it is preferably present at as low an amount as possible. More than 0.05 wt % of S deteriorates the hot processability of the alloy. Mn plays a role as a deoxidizer and is preferably contained at an amount of 1.0 wt % or less because an over-content causes brittleness of the alloy. As for Ni, an amount less than 20 wt % cannot form γ-phase austenite while an amount exceeding 40 wt % brings about a degeneration in the corrosion resistance to molten salts. Generally, Cr causes the alloys to be vulnerable to chloride-attributable corrosion. However, when considering anti-oxidation at high temperatures, the metal may be contained at an amount of up to 8 wt %.

The alloy steel prepared from the alloy composition of the present invention shows superior corrosion resistance to molten salts containing alkali oxides, particularly, the mixed molten salt LiCl—$Li_2O$. Under a condition of the mixed molten salt LiCl—$Li_2O$, Incoloy 800H is corroded at a rate which shows a linear kinetic change with regard to time. In contrast, the corrosion rate in the alloy steel according to the present invention exhibits a kinetic characteristic of a parabolic pattern. Further, the alloy steel of the present invention stably maintains its corrosion resistance to chloride and/or alkali oxide-containing molten salts even at high temperature in addition to being good in workability.

A better understanding of the present invention may be obtained in light of the following examples which are set forth to illustrate, but are not to be construed to limit the present invention.

EXAMPLES I TO V

Manufacture of Alloy Steel

KSA (Kaeri Superalloy) type alloy steel compositions shown in Table 1, below, were melted at 1,500° C. for 2 hours in a vacuum induction furnace, after which the melts were drawn from the furnace with the maintenance of the temperature at 1,450–1,500° C., to give ingots. The ingots were heated at 1,200° C. for 1 hour in an argon gas atmosphere, hot-rolled at 1,000–1,200° C., and subjected to heat treatment at 1,050° C. for 1 hour to form plates. As a control, Incoloy 800H (High Performance Alloys Inc., U.S.A.) was used.

TABLE 1

Compositions of Alloys

| Nos. of Examples | Alloys | Composition (wt %) Ni | Cr | Si | Mn | S | C | Fe |
|---|---|---|---|---|---|---|---|---|
| I | KSA-1 | 20 | 0 | <0.5 | <0.5 | <0.03 | <0.03 | Balance |
| II | KSA-2 | 33 | 0 | <0.5 | <0.5 | <0.03 | <0.03 | Balance |
| III | KSA-3 | 35 | 0 | <0.5 | <0.5 | <0.03 | <0.03 | Balance |
| IV | KSA-4 | 36 | 8 | <0.5 | <0.5 | <0.03 | <0.03 | Balance |
| V | KSA-5 | 32 | 29 | <0.5 | <0.5 | <0.03 | <0.03 | Balance |
| Control | Incoloy 800H | 31 | 22 | 0.53 | 1.07 | 0.006 | 0.08 | Balance |

EXPERIMENTAL EXAMPLE I

Test for Corrosion Resistance to Molten Salt LiCl

An examination was made of the corrosion resistance to molten salt LiCl using a crucible test method, one of many laboratory hot corrosion test methods.

The alloy plates obtained in the Examples were cut into specimens with a dimension of 15 mm×20 mm×2.5 mm. Immediately before being tested for the corrosion resistance, the specimens were polished with emery paper 1200, degreased with distilled water and acetone, and dried. In a crucible containing 22 g of the molten salt LiCl, the specimens were completely submerged and then, allowed to stand for 25–75 hours. The corrosion resistance test was conducted at 650° C., 750° C., and 850° C., respectively. After a lapse of the predetermined period of time, the specimens were taken out from the crucible, and washed with acid solutions in a sonicator to remove the corrosion products. KSA-1, KSA-2 and KSA-3 were washed with a 10% $H_2SO_4$ solution while a 10% $HNO_3$ solution was used to wash KSA-4, KSA-5 and Incoloy 800H. After being washed with distilled water and acetone, the specimens, free of the corrosion products, were dried and weighed. Because the alloy steels used were very similar in density, the corrosion rates on the alloy steels were expressed as the difference in weight per area before and after the corrosion resistance test.

Figure 1:
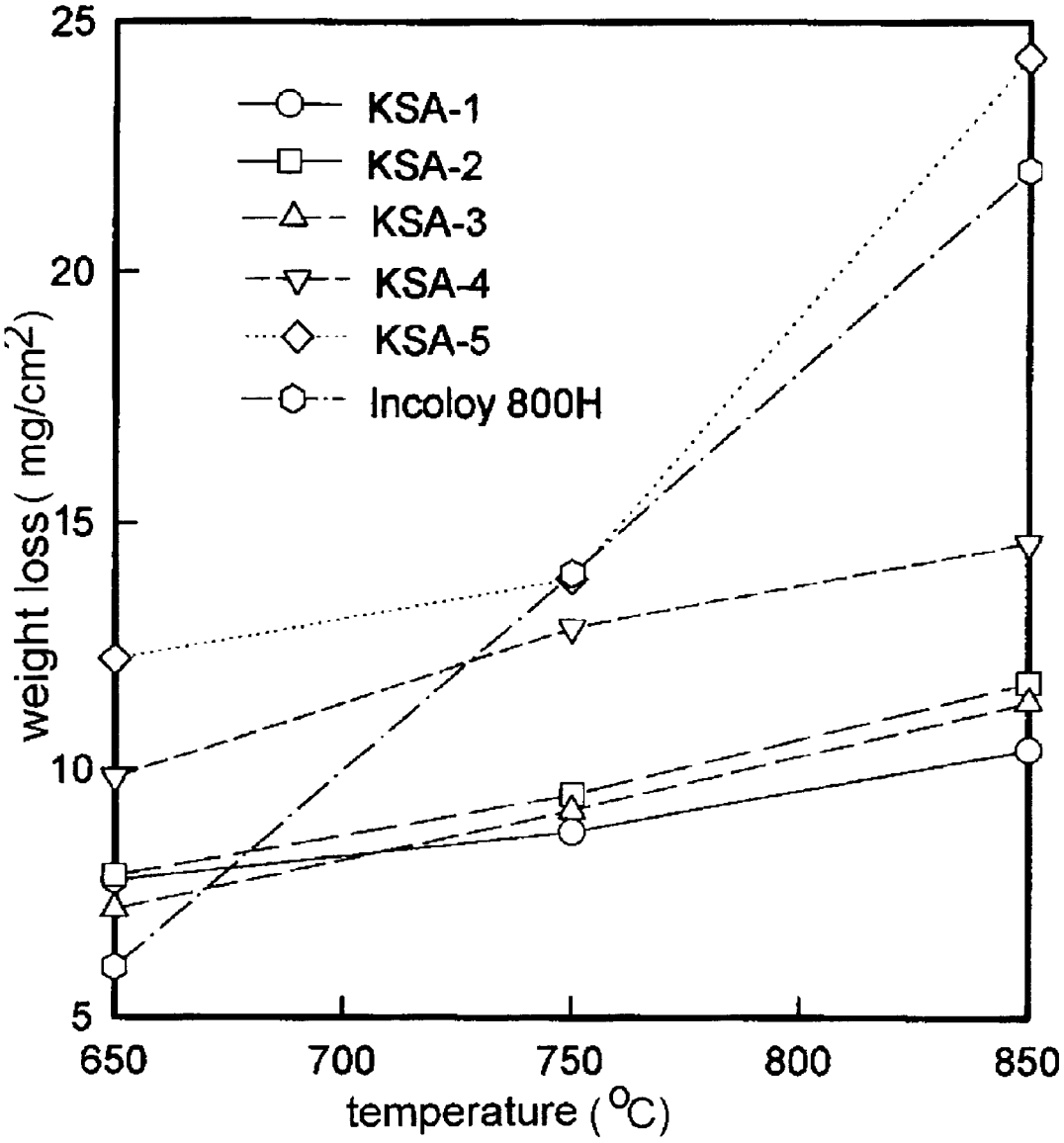
FIG. 1 is a graph in which weight loss is plotted for various alloy steels with regard to temperature after the alloy steels are allowed to be corroded by LiCl for 25 hours: -○-: KSA-1; -□-: KSA-2; -Δ-: KSA-3; -▽-: KSA-4; -◇-: KSA-5.

The test results were given in Table 2 and FIG. 1 in which weight loss per area is plotted against temperature when the specimens were allowed to stand for 25 hours in the molten salt LiCl.

TABLE 2

Corrosion Rates of Alloy Steels in Molten Salt LiCl

| Alloys | Weight Loss ($mg/cm^2$) 650° C. | 750° C. | 850° C. |
|---|---|---|---|
| KSA-1 | 7.78 | 8.76 | 10.42 |
| KSA-2 | 7.87 | 9.50 | 11.78 |
| KSA-3 | 7.20 | 9.18 | 11.39 |
| KSA-4 | 9.84 | 12.90 | 14.62 |
| KSA-5 | 12.26 | 13.89 | 24.31 |
| Incoloy 800H | 6.02 | 14.00 | 22.06 |

From the data shown in Table 2 and FIG. 1, it was recognized that Incoloy 800H was highly resistant to the corrosion of the molten salt LiCl at 650° C., but its corrosion rate was rapidly increased with the increasing of the temperature. For the alloy KSA-5, the corrosion rate was gradually increased at up to 750° C., but from that temperature, the corrosion rate was observed to rapidly increase. In contrast, the corrosion rates on the alloys KSA-1, 2, 3 and 4 were gradually increased as the temperature was increased. These results showed that lower Cr contents led to slower corrosion rates. As apparent from Table 2 and FIG. 1, the alloys according to the present invention stably maintained their corrosion resistance to the molten salt even at high temperatures.

With reference to FIG. 2, the corrosion rates of the specimens in molten salt LiCl are plotted with regard to time at 750° C. For all specimens tested, as seen, the corrosion rate curves are parabolic. In particular, the corrosion rate of the alloy KSA-3 is greatly decreased with the lapse of time, so that the alloy is highly resistant to the corrosion of LiCl.

EXPERIMENTAL EXAMPLE II

Test for Corrosion Resistance to Mixed Molten Salt LiCl—$Li_2O$

The same procedure as in Experimental Example I was repeated, except that the mixed molten salt LiCl-25% $Li_2O$, instead of the molten salt LiCl, was used. The test results were given in Table 3 and FIG. 3 in which weight loss per area is plotted against temperature when the specimens were allowed to stand for 25 hours in the mixed molten salt LiCl—$Li_2O$.

TABLE 3

Corrosion Rates to Alloy Steels in Molten Salt LiCl—$Li_2O$

| Alloys | Weight Loss ($mg/cm^2$) 650° C. | 750° C. | 850° C. |
|---|---|---|---|
| KSA-1 | 7.55 | 19.45 | 35.00 |
| KSA-2 | 5.72 | 17.15 | 32.37 |
| KSA-3 | 8.22 | 22.66 | 36.38 |
| KSA-4 | 7.80 | 25.76 | 78.17 |
| KSA-5 | 12.48 | 37.64 | 103.71 |
| Incoloy 800H | 8.91 | 27.94 | 82.44 |

At around 650° C., Incoloy 800H and KSA-1, 2, 3, 4 and 5 all were corroded at similar rates. The corrosion rate was increased with the increasing of the temperature and the increment in the corrosion rate was greater as the Cr content was larger. That is, the corrosion rates on KSA-4, Incoloy 800H and KSA-5, which are arranged in ascending Cr content order, were increased greater in order of the arrangement with the increasing of the temperature. On the other hand, for KSA-1, 2 and 3, which are free of Cr, the corrosion rate was gradually increased as the temperature was increased. These results showed that lower Cr contents led to slower corrosion rates against LiCl—$Li_2O$. As apparent from Table 3 and FIG. 3, the alloys according to the present invention stably maintained their corrosion resistance to the molten salt even at high temperature.

With reference to FIG. 4, the corrosion rates of the specimens in the mixed molten salt LiCl—$Li_2O$ are plotted with regard to time at 750° C. The corrosion rates on Incoloy 800H and KSA-5 are increased, following steep linear patterns. For KSA-3 and KSA-4, as seen, the corrosion rate curves are parabolic. In particular, the corrosion rate on the alloy KSA-3 in LiCl—$Li_2O$ is greatly decreased with the lapse of time, giving the information that the alloys with a Cr content of 8 wt % or less have superior corrosion resistance to the mixed molten salt LiCl—$Li_2O$.

Taken together, the data obtained above show that the alloy steels manufactured from the Ni—Cr—Fe based alloy composition with low Cr contents according to the present invention are superb in the corrosion resistance to chloride and/or alkali oxide-containing molten salts, particularly, LiCl—$Li_2O$. In addition, the alloy steels according to the present invention show stable corrosion resistance to molten salts even at high temperature as well as low temperature in addition to being superior to workability. Thus, the alloy steels can be processed into plates, bars or pipes which are used as a structural material for structural components for treating molten salts. For examples, the structural materials may be valves, fittings, and flanges.

The present invention has been described in an illustrative manner, and it is to be understood that the terminology used is intended to be in the nature of description rather than of limitation. Many modifications and variations of the present invention are possible in light of the above teachings. Therefore, it is to be understood that within the scope of the appended claims, the invention may be practiced otherwise than as specifically described.

What is claimed is:

1. Method of using an alloy in a corrosive environment of hot molten salts containing at least one of chlorides and alkali oxides, wherein said alloy having a composition consisting of the following constituents by weight percentages:

nickel from 20–40%;

plus each of the following constituents in the following amounts,

Cr—up to 8%,

C—0.05% or less,

Si—0.5 or less,

Mn—1.0% or less,

S—0.05% or less;

balance Fe to total weight, wherein said composition maintains corrosion resistance against hot molten salts containing at least one of chlorides and alkali oxides.

2. The method as set forth in claim 1, wherein the molten salts are molten salts of $Li_2O$, LiCl, $Na_2O$ and LiCl—$Li_2O$.

3. A method according to claim 1, wherein said alloy is an alloy steel of high corrosion resistance to hot molten salts, manufactured from said alloy.

4. A method according to claim 3, wherein said alloy is a structural material for treating hot molten salts, manufactured from said alloy.

5. The method as set forth in claim 4, wherein said material is a plate, a bar, a pipe, or the composite form thereof.

6. The method as set forth in claim 4, wherein said material is a valve, a fitting or a flange.

7. A method of manufacturing alloy steels of high corrosion resistance to hot molten salts, which comprises: casting an alloy having a composition comprising 20–40 weight % of Ni, 0–8 weight % of Cr, 0.05 weight % or less of C, 0.5 weight % or less of Si, 1.0 weight % or less of Mn, 0.05 weight % or less of S, and the balance of Fe to total weight; heating the cast alloy at 1200° C. for 1–2 hours in an inert gas atmosphere, and hot-rolling at 1000–1200° C.

8. The method as set forth in claim 7, further comprising the step of conducting a heat treatment at 1,000–1,100° C. for 1–2 hours in an inert gas atmosphere, after the hot-rolling step.

* * * * *

UNITED STATES PATENT AND TRADEMARK OFFICE

CERTIFICATE OF CORRECTION

PATENT NO. : 6,224,824 B1
APPLICATION NO. : 09/465575
DATED : May 1, 2001
INVENTOR(S) : Jun Shan Zhang et al.

It is certified that error appears in the above-identified patent and that said Letters Patent is hereby corrected as shown below:

Cover Page, the Assignee should be listed as follows:

Assignee: Korea Atomic Energy Research Institute, Taejon-si (KR);
and Korea Electric Power Corporation, Seoul (KR)

Signed and Sealed this
Tenth Day of May, 2011

David J. Kappos

David J. Kappos
*Director of the United States Patent and Trademark Office*